US006915843B2

(12) United States Patent
Kroliczek et al.

(10) Patent No.: US 6,915,843 B2
(45) Date of Patent: Jul. 12, 2005

(54) WICK HAVING LIQUID SUPERHEAT TOLERANCE AND BEING RESISTANT TO BACK-CONDUCTION, EVAPORATOR EMPLOYING A LIQUID SUPERHEAT TOLERANT WICK, AND LOOP HEAT PIPE INCORPORATING SAME

(75) Inventors: Edward J. Kroliczek, Davidsonville, MD (US); Kimberly R. Wrenn, Sykesville, MD (US); David A. Wolf, Sr., Baltimore, MD (US)

(73) Assignee: Swales & Associates, Inc., Beltsville, MD (US)

( * ) Notice: Subject to any disclaimer, the term of this patent is extended or adjusted under 35 U.S.C. 154(b) by 0 days.

(21) Appl. No.: 10/388,955

(22) Filed: Mar. 14, 2003

(65) Prior Publication Data

US 2003/0178184 A1 Sep. 25, 2003

Related U.S. Application Data

(62) Division of application No. 09/933,589, filed on Aug. 21, 2001, now Pat. No. 6,564,860, which is a division of application No. 09/571,779, filed on May 16, 2000, now Pat. No. 6,382,309.

(51) Int. Cl.[7] ..... F28D 15/00

(52) U.S. Cl. ..... 165/104.33; 165/104.26; 165/80.4; 361/700; 257/715

(58) Field of Search ..... 165/104.26, 104.21, 165/104.33; 361/700; 174/15.2; 257/715

(56) References Cited

U.S. PATENT DOCUMENTS

| | | | |
|---|---|---|---|
| 3,490,718 | A | 1/1970 | Vary |
| 3,613,778 | A | 10/1971 | Feldman |
| 3,734,173 | A | 5/1973 | Moritz |
| 3,786,861 | A | 1/1974 | Eggers |
| 3,965,334 | A | 6/1976 | Asselman et al. |

(Continued)

FOREIGN PATENT DOCUMENTS

| | | |
|---|---|---|
| GB | 2 312 734 | 5/1997 |
| JP | 04126995 | 4/1992 |
| JP | 09264681 | 10/1997 |
| JP | 10246583 | 9/1998 |
| JP | 2000055577 | 2/2000 |
| JP | 2000146471 | 5/2000 |

OTHER PUBLICATIONS

"Micro–Cooler for Chip–Level Temperature Control" by Kirshberg, J., Yerkes, K., and Liepmann, D. SAE Aerospace Power Systems Conference, Paper #1999–01–1407, P–341, 1999, pp. 233–237.

(Continued)

*Primary Examiner*—Terrell Mckinnon
(74) *Attorney, Agent, or Firm*—Fish & Richardson P.C.

(57) ABSTRACT

A capillary wick for use in capillary evaporators has properties that prevent nucleation inside the body of the wick, resulting in suppression of back-conduction of heat from vapor channels to the liquid reservoir. Use of a central liquid flow channel in the wick is eliminated, and pore size in the wick is chosen to maximize available pressure for fluid pumping, while preventing nucleation in the wick body. The wick is embodied with different geometries, including cylindrical and flat. A flat capillary evaporator has substantially planar heat input surfaces for convenient mating to planar heat sources. The flat capillary evaporator is capable of being used with working fluids having high vapor pressures (i.e., greater that 10 psia). To contain the pressure of the vaporized working fluid, the opposed planar plates of the evaporator are brazed or sintered to opposing sides of a metal wick. Additionally, a terrestrial loop heat pipe and a loop heat pipe having overall flat geometry are disclosed.

27 Claims, 13 Drawing Sheets

U.S. PATENT DOCUMENTS 4,046,190 A 9/1977 Marcus et al.
4,087,893 A 5/1978 Sata et al.
4,116,266 A 9/1978 Sawata et al.
4,170,262 A 10/1979 Marcus et al.
4,322,737 A * 3/1982 Sliwa, Jr. ..... 257/719
4,467,861 A 8/1984 Kiseev et al.
4,470,450 A 9/1984 Bizzell et al.
4,503,483 A 3/1985 Basiulis
4,515,209 A 5/1985 Maidanik et al.
4,602,679 A 7/1986 Edelstein et al.
4,685,512 A 8/1987 Edelstein et al.
4,770,238 A 9/1988 Owen
4,830,097 A 5/1989 Tanzer
4,883,116 A 11/1989 Seidenberg et al.
4,903,761 A 2/1990 Cima
4,934,160 A 6/1990 Mueller
5,002,122 A 3/1991 Sarraf et al.
5,216,580 A * 6/1993 Davidson et al. ..... 361/700
5,335,720 A 8/1994 Ogushi et al.
5,355,942 A 10/1994 Conte
5,390,077 A * 2/1995 Paterson ..... 361/700
5,412,535 A 5/1995 Chao et al.
5,427,174 A 6/1995 Lomolino, Sr. et al.
5,642,776 A 7/1997 Meyer, IV et al.
5,694,295 A * 12/1997 Mochizuki et al. ..... 361/699
5,697,428 A * 12/1997 Akachi ..... 165/104.21
5,725,049 A 3/1998 Swanson et al.
5,761,037 A 6/1998 Anderson et al.
6,064,572 A * 5/2000 Remsburg ..... 361/700
6,158,502 A * 12/2000 Thomas ..... 165/104.26
6,163,073 A * 12/2000 Patel ..... 257/712
6,227,287 B1 * 5/2001 Tanaka et al. ..... 165/80.4
6,241,008 B1 6/2001 Dunbar
6,257,320 B1 * 7/2001 Wargo ..... 165/80.4
6,301,109 B1 * 10/2001 Chu et al. ..... 361/690
6,443,222 B1 * 9/2002 Yun et al. ..... 165/104.26
2001/0025701 A1 * 10/2001 Ikeda et al. ..... 165/80.3

OTHER PUBLICATIONS

Marks' Standard Handbook for Mechanical Engineers, 9th Edition, pp. 13–22, 13–23, 13–41 (1987).

Khurstalev D., "Inexpensive Small–scale Loop Heat Pipes with In Situ Sintered Wicks," Technology'99, University of Maryland, MD, May 1999.

* cited by examiner

WICK HAVING LIQUID SUPERHEAT TOLERANCE AND BEING RESISTANT TO BACK-CONDUCTION, EVAPORATOR EMPLOYING A LIQUID SUPERHEAT TOLERANT WICK, AND LOOP HEAT PIPE INCORPORATING SAME

CROSS REFERENCE TO RELATED APPLICATIONS

This application is a divisional of application Ser. No. 09/933,589, filed Aug. 21, 2001 now U.S. Pat. No. 6,564,860, which is a divisional of application Ser. No. 09/571,779, filed May 16, 2000, now U.S. Pat. No. 6,382,309. The Ser. No. 09/571,779 application is incorporated by reference herein, in its entirety, for all purposes.

INTRODUCTION

The present invention relates generally to the field of heat transfer. More particularly, the present invention relates to wicks for use in loop heat pipe evaporators.

BACKGROUND OF THE INVENTION

There are numerous instances where it is desirable to transfer heat from a region of excess heat generation to a region where there is too little heat. The object is to keep the region of heat generation from getting too hot, or to keep the cooler region from getting too cold. This is a typical thermal engineering problem encountered in a wide range of applications including building environmental conditioning systems, spacecraft thermal control systems, the human body, and electronics.

A variety of techniques can be employed to achieve this heat sharing effect. These include heat straps (simple strips of high conductivity material), closed loops of pumped single-phase fluid, heat pipes, mechanically pumped two-phase loops, and capillary pumped two-phase loops.

The most advanced and efficient concept is the capillary pumped two-phase loop and the related loop heat pipe (LHP). LHP technology has recently been developed for spacecraft applications due to its very low weight to heat transferred ratio, high reliability, and inherent simplicity.

An LHP is a two-phase heat transfer system. The LHP is a continuous loop in which both the vapor and the liquid always flow in the same direction. Heat is absorbed by evaporation of a liquid-phase working fluid at the evaporator section, transported via the vaporized fluid in tubing to a condenser section to be removed by condensation at the condenser. This process makes use of a fluid's latent heat of vaporization/condensation, which permits the transfer of relatively large quantities of heat with small amounts of fluid and negligible temperature drops. A variety of fluids including ammonia, water, freons, liquid metals, and cryogenic fluids have been found to be suitable for LHP systems. The basic LHP consists of an evaporator section with a capillary wick structure, of a pair of tubes (one of the tubes is for supply of fluid in its liquid state, and the other is for vapor transport), and a condenser section. In many applications, the pressure head generated by the capillary wick structure provides sufficient force to circulate the working fluid throughout the loop, even against gravity. In other applications, however, the pressure differential due to fluid frictional losses, static height differentials, or other forces may be too great to allow for proper heat transfer. In these situations it is desirable to include a mechanical pump to assist in fluid movement. Systems employing such pumps are called hybrid capillary pumped loops.

In designing LHP evaporators, the art has long taught the use of cylindrical geometry, particularly for use in containing high pressure working fluids, such as ammonia. Referring to FIGS. 1–3, prior art evaporators 10, 30, 50 are illustrated as having cylindrical geometry, where a wick 4 has a central flow channel 2 and is surrounded at its periphery by a plurality of peripheral flow channels 6. Capillary evaporators having a central channel 2 in the wick 4 are sensitive to a problem called back-conduction.

Back-conduction in capillary evaporators refers to the heat transfer due to a temperature gradient across the wick structure, between the vapor grooves 6 in the evaporator and the liquid that is returning to the evaporator in the central channel 2. This energy is normally balance by sub-cooled liquid return and/or heat exchange at the hydro-accumulator in the case of loop heat pipes. Refer to Ku, J., "Operational Characteristics of Loop Heat Pipes", SAE paper 99-01-2007, 29th International Conference on Environmental Systems, Denver, Colo., Jul. 12–15, 1999, which is incorporated herein by reference in its entirety.

It would be beneficial to minimize back-conduction for several reasons. First, decreased back-conduction would permit minimization, or even elimination, of liquid return sub-cooling requirements. Second, decreased back-conduction would allow the evaporator operating temperature to approach sink temperature, particularly at low power. Third, decreased back-conduction would allow loop heat pipes to operate at low vapor pressure, where the low slope of the vapor pressure curve allows small pressure differences in the loop to result in large temperature gradients across the wick. Finally, decreased back-conduction would minimize sensitivity to adverse elevation.

Thus, what is needed is a wick for use in an LHP evaporator that has improved back-conduction performance.

Aside from any back-conduction considerations, another inherent disadvantage of the cylindrical evaporator is its cylindrical geometry, since many cooling applications call for transferring heat away from a heat source having a flat surface. This presents a challenge of how to provide for good heat transfer between the curved housing of a cylindrical evaporator and a flat surfaced heat source.

Typically, the evaporator housing is integrated with a flat saddle to match the footprint of the heat source and the surface temperature of the saddle is dependent upon the fin efficiency of the design. FIG. 1 shows a prior art cylindrical evaporator 10 (cross section perspective view) integrated with a single saddle 20 for mounting to a single, flat-surface heat source (not shown). Heat energy is received via a single heat input surface 22. FIG. 3 shows an alternative design for a prior art cylindrical evaporator 30 (cross section perspective view) integrated with a single saddle 40 that has extended fins. Heat energy is received via a single heat input surface 42. FIG. 2 shows a prior art cylindrical evaporator 50 (cross section perspective view) integrated with two saddles 60, 70. Heat energy is received via two opposed heat input surfaces 62, 72.

For large heat sources, requiring isothermal surfaces, multiple evaporators are often required. The number of required evaporators would also increase as the thickness of the envelope available for integrating the evaporator (i.e., the distance between the heat input surface 22 and the bottom 24 of the evaporator of FIG. 1, or the distance between the opposed heat input surfaces 62, 72 of the evaporator of FIG. 2) decreases. That is because the width of the cylindrical evaporator is a function of the evaporator diameter and the diameter is limited to integration thickness.

Increasing the number of evaporators increases the cost and complexity of the heat transport system.

Capillary evaporators with flat geometry have been devised, which match a heat source having rectangular geometry. Flat geometry eliminates the need for a saddle and avoids the inherent thickness restraints currently imposed upon cylindrical capillary evaporators.

The art of flat capillary evaporators for use with high-pressure working fluids teaches use of structural supports for resisting any deformation forces exerted thereon due to the pressure of the working fluid. The plates are sealed together, which often requires use of bulky clamps or thick plates. Clamps, thick plates and added support mechanisms have the disadvantages of unnecessary weight, thickness and complexity.

U.S. Pat. No. 5,002,122 issued to Sarraf et al. for Tunnel Artery Wick for High Power Density Surfaces relates to the construction of an evaporator region of a heat pipe, having a flat surface 12 for absorbing high power densities. Control of thermally induced strain on the heated surface 12 is accomplished by an array of supports 14 protruding through the sintered wick layer 18 from the backside of the heated surface and abutting against a heavier supporting structure 16. The sintered wicks 18 are taught as being made from silicon and glass. The supports 14 protruding through the wick 18 are bonded to the plate 12 to provide the necessary support.

U.S. Pat. No. 4,503,483 issued to Basiulis for Heat Pipe Cooling Module for High Power Circuit Boards is directed to a heat pipe having an evaporator section configured as a flat pipe module 22 for attaching directly to electronic components 28. This evaporator assembly sandwiches two wicks 36 between two opposing plates 34. Refer to FIG. 4. Basiulis teaches use of a central separator plate 38 having bars 40, which solidly connect the opposing plates 34 to provide strength and prevent mechanical deformation. Refer to col. 3, lines 3–11.

U.S. Pat. No. 4,770,238 issued to Owen for Capillary Heat Transport and Fluid Management Device is directed to a heat transport device with a main liquid channel 22 and vapor channels 24, 26, 32, 34 containing wick material 36. The liquid channel 22 and vapor channels 24, 26, 32, 34 are disposed between flat, heat conducting plate surfaces 14, 16. The plates 14, 16 are separated by ribs 38, 40, 42, 44 having a thickness that provides structural stiffness.

U.S. Pat. No. 4,046,190 issued to Marcus et al. for Flat Plate Heat Pipe relates to flat plate vapor chamber heat pipes having two flat plates 2, 3 sealed together in parallel planes. Spacing studs 4 are aligned at regular intervals to provide structural support for the plates 2, 3, as well as to serve as an anchor for metal wicking 5.

U.S. Pat. No. 4,685,512 issued to Edelstein et al. for Capillary Pumped Heat Transfer Panel and System discloses a capillary-pumped heat transfer panel having two plates and a wick. Each plate has a network of grooves for fluid communication with a liquid line, and thus has corresponding non-groove portions that form the thick walls of the grooves on the interior surface of the plate. When the plates are sealed together, these non-groove portions, which form the walls of the grooves and have very substantial thickness relative to the wick material, serve the function of supporting structures for the assembly.

The main disadvantages of support structures such as studs, bars, ribs, and the like (i.e., Sarraf et al., Basiulis, Marcus et al., and Owen) and bulky walls (i.e., Edelstein et al.) are that they add weight to the evaporators. Flat plate evaporators without support structures are known in the prior art, but are useful only in relatively low pressure systems so as to avoid deformation of the unsupported flat plates, which would be the natural result of pressure forces exerted by high pressure working fluids, such as ammonia.

U.S. Pat. No. 3,490,718 issued to Vary for Capillary Radiator teaches capillary type radiator construction that is flexible or foldable. This patent discloses an embodiment without use of an intermediate spacer means for forming the capillary passages, and thus no separate support is provided for the plates of this embodiment. Vary teaches, however, that a radiator mechanism based on this concept must be in a relatively low pressure system in which the combined header and vapor pressures remain below about 10 psia.

U.S. Pat. No. 5,642,776 issued to Meyer, IV et al. for Electrically Insulated Envelope Heat Pipe is essentially a heat pipe in the form of a simple foil envelope. Two plastic coated metal foil sheets are sealed together on all four edges to enclose a wick that is a semi-rigid sheet of plastic foam with channels cut in its surfaces. The disclosed working fluid is water, a relatively low-pressure working fluid. The Meyer, IV et al. disclosure does not address the issues of containment of high-pressure working fluids in flat capillary evaporators.

Thus, there is a need for a flat capillary evaporator that has the structural integrity to accommodate high-pressure working fluids, while avoiding the bulky mass of support structures such as ribs or thick walls.

In many terrestrial applications, including electronics, heat is dissipated from a heat source via a passive heat sink, a heat sink aided by a fan, or other conventional means. The conventional schemes do not have the low weight to heat transferred ratio characteristic of LHP technology. Unfortunately, prior art LHPs have not provided for a way to reduce back-conduction, which is often large due to the hydrostatic pressure caused by height differentials that arise in terrestrial applications. The temperature gradient across the wick is directly proportional to the pressure difference across the wick. That is to say, gravity causes hydrostatic pressure, which increases the temperature gradient across the wick, which increases back-conduction, and high back conduction limits LHP design choices by requiring high-pressure working fluids. This excludes water (a desirable choice) and other low-pressure fluids as a practical choices for terrestrial applications.

Thus, what is needed is an LHP that can operate under terrestrial conditions with reduced back-conduction.

Prior art LHPs are bulky, with an evaporator and condenser that tend to be physically distanced from one another. However, these prior art LHP configurations are not well suited for applications where the heat input surface and the heat output surface are intimately close to one another.

Thus, what is needed is an LHP that is physically compact with the various components integrated into a unitary package.

SUMMARY OF THE INVENTION

It is an object of the present invention to provide a wick for use in an LHP evaporator that has improved back-conduction performance.

It is a further object of the present invention to provide a liquid superheat tolerant wick that will reduce back-conduction in evaporators regardless of evaporator geometry and regardless of whether the vapor pressure of the working fluid used is high or low.

It is another object of the present invention to provide a flat capillary evaporator that has the structural integrity to accommodate high-pressure working fluids, while avoiding the bulky mass of support structures such as ribs or thick walls.

An object of the present invention is to provide a capillary evaporator having a thin-walled flat geometry with minimal weight.

Another object of the present invention is to provide a capillary evaporator having a thin-walled flat geometry and being suitable for use with both high-pressure and low-pressure working fluids.

It is another object of the present invention to provide a capillary evaporator having a thin-walled flat geometry and being suitable for use with low-pressure working fluids.

Yet another object of the present invention is to provide a capillary evaporator having a geometry with minimal thickness at the heat transfer interface.

An additional object of the present invention is to provide a capillary evaporator having a thin-walled flat geometry with minimal temperature difference across the heat transfer interface.

A further object of the present invention is to avoid the need for clamps to hold together the plates of a capillary evaporator having flat geometry.

Yet another object of the present invention is to avoid the need for a saddle to match the footprint of the heat source to a cylindrical evaporator.

Still another object of the present invention is to provide a lightweight, flat capillary evaporator that can be easily integrated, at minimal clearance, with a flat-surface heat source.

An additional object of the present invention is to provide the mechanical strength necessary to hold two opposing housing plates of a flat evaporator to a metal wick, and rely on the tensile strength of the wick material, so as to prevent deformation of the plates.

Still another object of the present invention is to provide a method for assembling a lightweight flat capillary evaporator.

A further object of the present invention is to provide a capillary evaporator having a liquid superheat tolerant wick.

An additional object of the present invention is to provide a capillary evaporator having etched microchannels as vapor grooves.

It is yet another object of the present invention to provide an LHP that can reliably operate under terrestrial conditions regardless of the vapor pressure of the working fluid.

It is still another object of the present invention to provide an LHP that is physically compact with the various components integrated into a unitary package.

The above objects are obtained by a capillary wick that has a structure resistant to back-conduction. The wick has a configuration that is liquid superheat tolerant.

Some of the above objects are obtained by a flat capillary evaporator including a first plate, a primary wick, and a second plate. The primary wick is sandwiched between the first and second plates and is bonded to the first and second plates. Optionally, a secondary wick is also included in a liquid manifold, which facilitates entry of a working fluid into the primary wick.

Certain of the above objects are obtained by a capillary evaporator including a liquid return, plural vapor grooves in fluid communication with a vapor outlet, and a wick. The wick has a first surface adjacent the liquid return and a second surface adjacent the vapor grooves, wherein pore size within the wick prevents nucleation of a working fluid between the first surface and the second surface. The evaporator may have any geometry, including cylindrical, flat, etc.

Others of the above objects are obtained by a flat capillary evaporator that includes a first plate, a second plate, a primary wick sandwiched between the first and second plates, and means for preventing substantial deformation of the first and second plates in the presence of vapor of a working fluid. The means for preventing is embodied by the firm affixation (i.e., bonding) of the plates to the wick so that the plates draw structural support from the tensile strength of the wick.

Some of the above objects are obtained by a heat transfer device that includes an evaporator. The evaporator includes at least one vapor groove, a vapor manifold, and a liquid manifold has a liquid return line. Liquid flows into the liquid return line and flows through the wick without nucleation in the wick. The heat applied to the heat input surface(s) evaporates the liquid and the vapor forms in vapor grooves that are machined into the metal housing and/or the wick.

While the wick may optionally have channels for liquid flow, a significant benefit of a continuous, liquid superheat tolerant wick is to minimize heat conduction from the vapor grooves to the liquid manifold. As a consequence, the amount of subcooling required for loop operation is minimized. If the wick has channels for liquid flow, a secondary wick is optionally used to supply liquid to the primary wick. The secondary wick is configured to channel any vapor returning in the liquid return line to the reservoir.

One of the above objects is obtained by a terrestrial loop heat pipe that includes an evaporator, a condenser, a vapor line, and a liquid return line. The evaporator has a liquid inlet, a vapor outlet, and a liquid superheat tolerant capillary wick. The condenser has a vapor inlet and a liquid outlet. The vapor line provides fluid communication between the vapor outlet and the vapor inlet. The liquid return line provides fluid communication between the liquid outlet and the liquid inlet. The loop heat pipe operates reliably in a terrestrial gravitational field.

At least one of the above objects is obtained by a cooling device for cooling heat generating components. The cooling device has a heat sink with a heat receiving face, and a loop heat pipe embedded in the face of the heat sink.

BRIEF DESCRIPTION OF THE DRAWINGS

Additional objects and advantages of the present invention will be apparent in the following detailed description read in conjunction with the accompanying drawing figures.

DETAILED DESCRIPTION OF THE PREFERRED EMBODIMENTS

The Wick Aspects of the Invention

Figure 3:
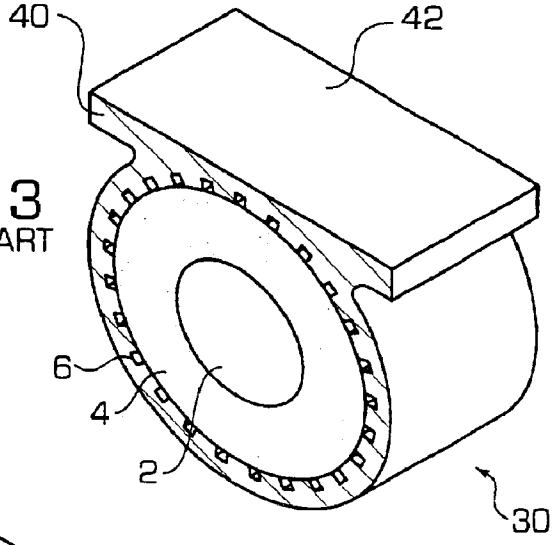
FIG. 3 PRIOR ART
FIG. 3 illustrates a cross section perspective view of yet another example of a prior art capillary evaporator having cylindrical symmetry.

An evaporator wick embodied according to the present invention is resistant to back-conduction of heat energy. Another aspect of a wick embodied according to the present invention is liquid superheat tolerance.

Two factors significantly affect how much back-conduction occurs through the wick of a capillary evaporator: (1) the temperature gradient between the vapor grooves and the liquid return, and (2) the thermal resistance between the vapor grooves and the liquid return. Back-conduction decreases with a decreasing temperature gradient. Back-conduction increases with a decreasing thermal resistance. Thus, minimizing the temperature gradient across the wick and increasing the thermal resistance of the wick reduce back-conduction.

Reducing the temperature gradient across the wick is obtained by preventing nucleation from occurring in the liquid return central flow channel 2 and in the wick 4. One factor in preventing bubble formation in the wick is to ensure that the wick is without significant variations in pore size, i.e., that the wick is homogeneous. Furthermore, liquid superheat tolerance is promoted by selection of a pore size small enough to prevent nucleation of superheated liquid flowing through the wick from the liquid return to the vapor channel. Additionally, elimination of the central flow channel 2 also reduces the temperature gradient. This allows the liquid flowing from the liquid return through the wick to the vapor grooves to superheat, making the wick liquid superheat tolerant. The property of liquid superheat tolerance implies that nucleation is effectively suppressed.

The pore sizes may be uniform (i.e., homogeneous) across the wick material, or alternately, the pore sizes may be graded across the wick (e.g., according to the localized pressure within the wick).

Increasing the thermal resistance between the vapor grooves and the liquid return is achieved by selecting a wick material having a low thermal conductivity, and/or by creating longer conduction paths. In the prior art wicks having a central flow channel 2 (refer to FIGS. 1–3), the back-conduction path is radially through the wick 4. As the diameter of the central flow channel 2 is reduced, the back-conduction path length increases, thereby increasing thermal resistance. By eliminating the central flow path 2 altogether, the return liquid is forced to flow axially along the wick. Forcing axial flow significantly increases path length, and consequently increases thermal resistance.

Thus, by removing the central liquid flow channel 2, to create a liquid superheat tolerant wick, back-conductance is also decreased by increasing the thermal resistance.

One aspect of a wick according to the present invention is pore size selection to promote nucleation suppression. Another aspect of a wick according to the present invention is a low thermal conductive path between the vapor channels and the liquid return line to minimize back-conduction. Still another aspect of a wick according to the present invention is a small pore size to promote a high capillary pumping pressure. Yet another aspect of a wick according to the present invention is high permeability for low pressure drop across the wick. A further aspect of a wick according to the present invention is high tensile strength for containing high-pressure working fluids.

Not all of the above-mentioned characteristics need necessarily be present in each embodiment to obtain the objects of the present invention. In fact some are trade-offs with respect to one another to a certain degree. Altering one aspect to favor performance often has an adverse effect on another aspect. For example, decreasing wick pore size often decreases permeability so that the additional pressure drop inside the wick offsets, at least partially, the increasing in capillary pumping pressure. Good performance is established by selecting the pore size that provides the maximum available pressure drop exterior to the evaporator for a given evaporator design. The maximum available pressure drop exterior to the evaporator, $\Delta P_{AVAILABLE}$, is defined according to the relation $$\Delta P_{AVAILABLE}=\Delta P_{CAPILLARY}-\Delta P_{DROP},$$

where $\Delta P_{CAPILLARY}$ is the capillary pressure rise across the wick and $\Delta P_{DROP}$ is the pressure drop across the evaporator. A detailed example of pore selection is described below.

A wick embodied according to the present invention is useful in a wide range of capillary evaporators. It is beneficial for evaporators of diverse geometries, including flat and cylindrical. It is beneficial for evaporators that require the wick be made from diverse materials, including non-metalic wicks (e.g., polymeric, ceramic) and metal wicks. Additionally, a wick embodied according to the present invention is useful with a wide variety of working fluids (water, ammonia, butane, freons, etc.), including those that have a low vapor pressure and those that have a high vapor pressure.

Another example of altering wick properties to favor performance with an adverse effect on another property is to increase wick tensile strength by using metal wicks instead of plastic wicks for high-pressure fluids. This material change increases the wick's thermal conductivity and, thus, the back-conduction between the vapor channels and the liquid return is increased. One way to reduce the effect of increased wick thermal conductivity is to use a wick having properties that strongly favor liquid superheat tolerance.

A liquid superheat tolerant wick is defined as a continuous wick structure having a sufficiently small pore size along the liquid flow path, so as to permit stable operation with superheated liquid in the wick, and not allow nucleation along the liquid flow path. Nucleation occurs at pores where bubbles larger than the critical bubble radius can exist. Methods for determining the appropriate pore size required for nucleation to occur are discussed in Rohsenow, W. M. and Hartnett, J. P., eds. "Boiling" in Handbook of Heat Transfer, Ch. 12, (McGraw-Hill 1973), which is incorporated herein by reference in its entirety. The degree to which the liquid is superheated is defined as the difference between the temperature of the liquid and the local saturation temperature. Changes in the local saturation temperature correspond to changes in local pressure due to liquid flow through the wick.

A nucleation suppressant wick is not limited to a homogenous wick or a wick of strictly uniform properties. For example, a graded porosity wick can provide nucleation suppression, provided that the grading does not permit the local pore size to exceed the critical bubble radius of the superheated liquid. Wicks with internal channels larger than the critical bubble radius are also nucleation suppressant provided that the channel is not part of the liquid flow path through the wick. A nucleation suppressant wick can be made of metallic or non-metallic materials.

Figure 5:
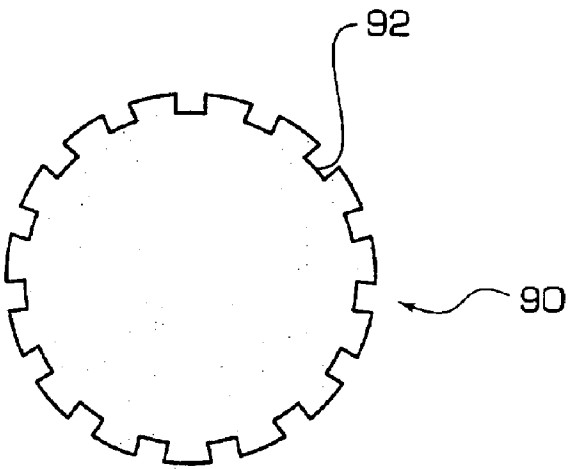
FIG. 5 illustrates a cross-section view of the wick of FIG. 4.
Figure 4:
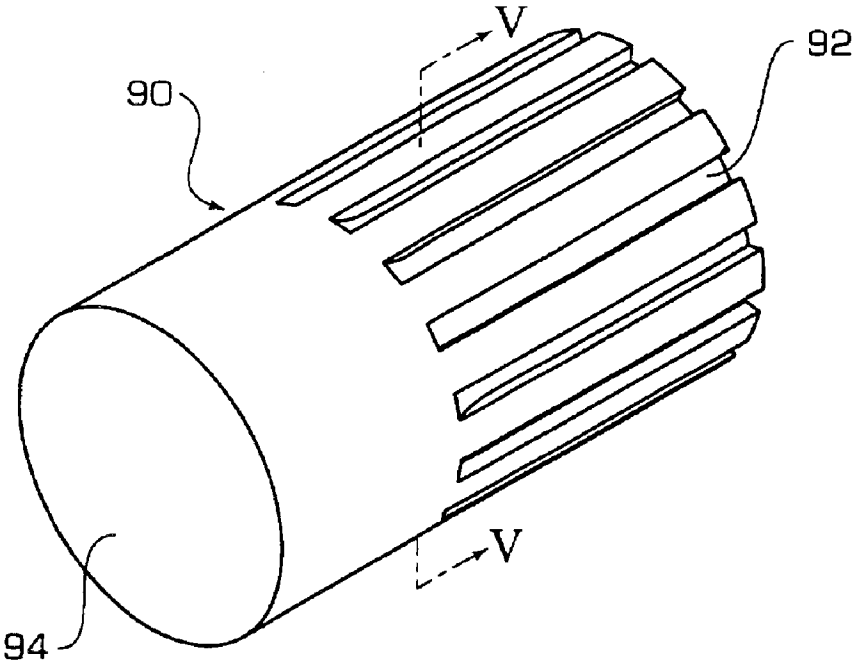
FIG. 4 illustrates a perspective view of a liquid superheat tolerant wick according to an embodiment of the present invention.

Referring to FIGS. 4 and 5, a liquid superheat tolerant wick 90 according to an embodiment of the present invention is illustrated, which is designed to allow stable evaporator operation with superheated liquid in the evaporator zone for the purpose of reducing back-conduction. The liquid superheat tolerant wick 90 is continuous in the liquid flow direction, with sufficiently small pore size to prevent nucleation of superheated liquid inside the wick during operation. An important distinction between a liquid superheat tolerant wick 90 and wicks according to the prior art is that the central flow channel is eliminated to promote nucleation suppression. The face 94 where liquid enters the wick 90 has no central channel bored therein. This liquid superheat tolerant configuration minimizes wick back-conduction from the vapor grooves 92 to the liquid inlet. The wick 90 has vapor grooves 92 but no central flow channel.

Figure 2:
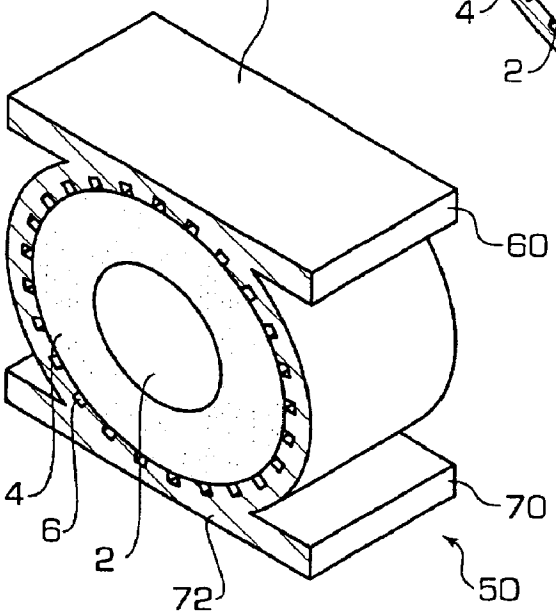
FIG. 2 PRIOR ART
FIG. 2 illustrates a cross section perspective view of another example of a prior art capillary evaporator having cylindrical symmetry.
Figure 1:
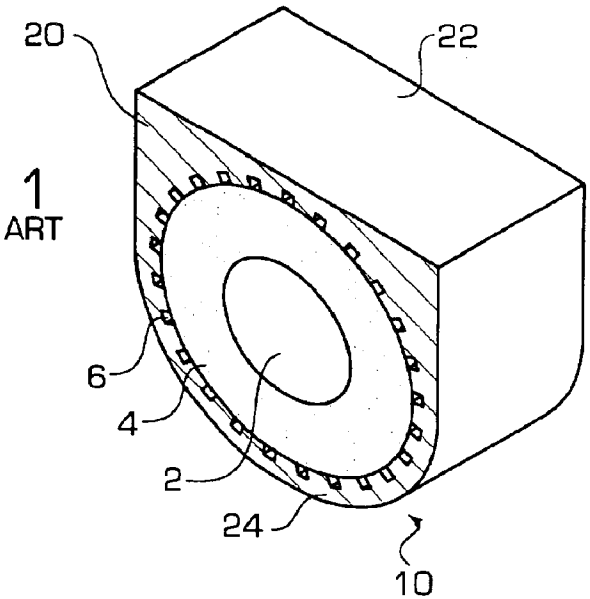
FIG. 1 PRIOR ART
FIG. 1 illustrates a cross section perspective view of an example of a prior art capillary evaporator having cylindrical symmetry.

Alternately, vapor grooves may be machined into either the wick (as is shown in FIG. 4) or into the evaporator wall (as is shown in FIGS. 1–3).

Figure 6:
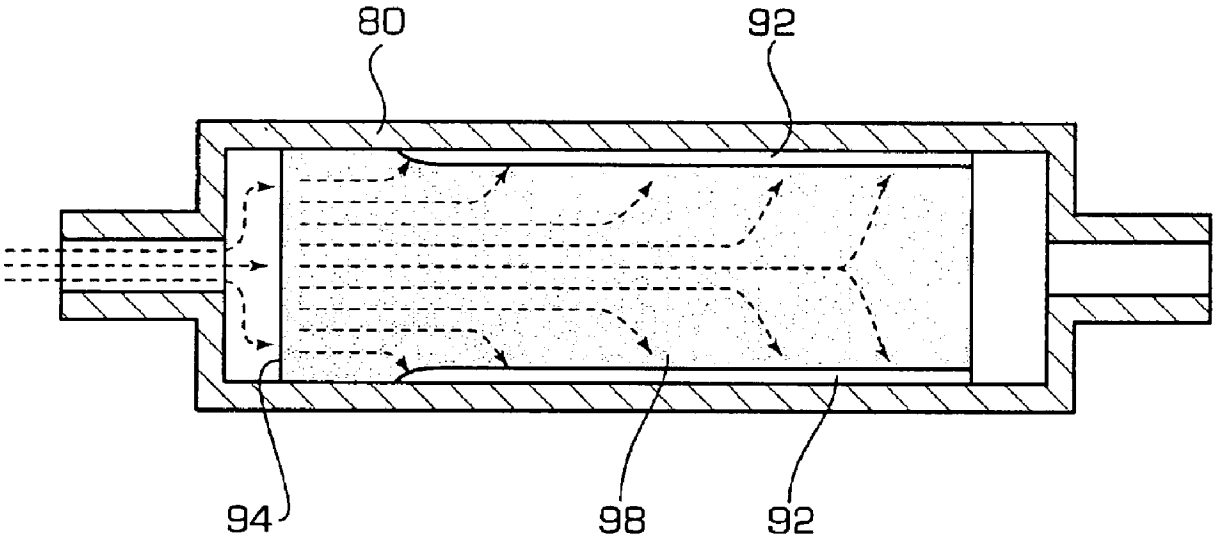
FIG. 6, illustrates a cross-section view of a wick, according to an embodiment of the present invention, along its longitudinal axis, inside an evaporator housing 80, which shows schematically liquid flow paths through the interior of the wick body.

Referring to FIG. 6, a schematic diagram (a cross-section view of the wick along its longitudinal axis, inside an evaporator housing 80) illustrates liquid flow paths (broken lines) through the interior of the liquid superheat tolerant wick body 98 from the face 94 where liquid evaporates into the vapor grooves 92. This schematic view is simplified (to provide clear illustration) in that it does not portray certain preferred liquid return mechanism information (refer to FIG. 10, for example, for more details on these aspects of the preferred embodiment).

The Flat Capillary Evaporator Embodiment

According to one embodiment of the present invention, an evaporator for use in an LHP is configured in a flat geometry that is compatible with choosing a high-pressure working fluid.

A flat evaporator is configured to mate conveniently with the flat surfaces that are common to heat generating devices. In order to keep the flat sides of the evaporator from bulging out due to the vapor pressure exerted by the vaporized working fluid, a continuous wick is employed. By bonding the flat sides of the evaporator to the wick, the tensile strength of the wick holds the sides in and keeps them from deforming outwardly.

An important aspect of this embodiment is that the evaporator need not be strictly "flat" but, rather, is capable of being formed in a thin geometry that is curved or irregular. The shaping of the "flat" evaporator embodiment into non-flat configurations is a matter of convenience to provide good thermal coupling to heat source surfaces that are curved or irregular. In other words, the flatness of the flat capillary evaporator is not essential to the invention; it is simply a convenient shape for purposes of description.

Figure 7:
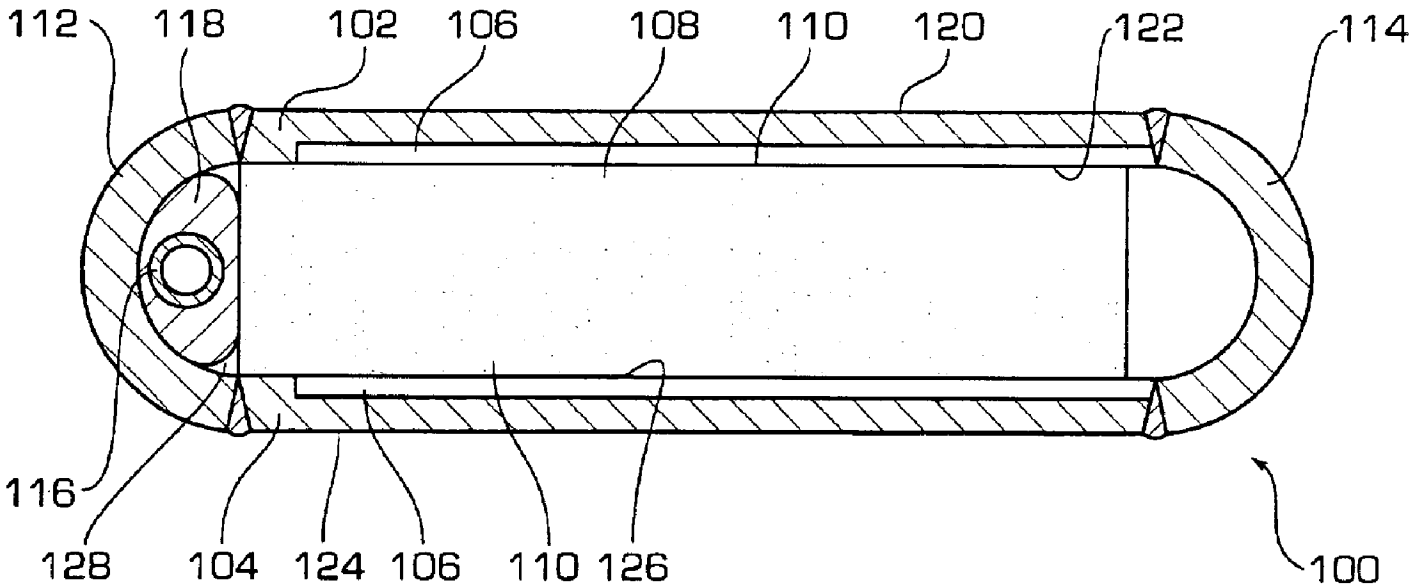
FIG. 7 illustrates a cross-section of a flat capillary evaporator according to an embodiment of the present invention.

Referring to FIG. 7, an evaporator 100 according to a preferred embodiment is shown as having two substantially planar opposing plates 102, 104, each having vapor grooves 106. The plates 102, 104 are typically formed of stainless steel and are bonded to a metal wick 108 by a bond 110, for the purpose of using the strength of the wick 108 for pressure containment. The bond 110 may be formed by sintering or brazing. The bond 110 runs the length of the plates 102, 104.

According to alternative embodiments, rather than forming the vapor grooves 106 in the plates 102, 104, the vapor grooves 106 are formed in the wick 108 adjacent to where the wick 108 is bonded to the plates 102, 104. As another alternative, vapor grooves are formed both in the plates 102, 104 and in the wick 108.

Bonding is a broad class of joining techniques, of which sintering and brazing are preferred. Sintering is application of pressure below the applicable melting temperature over a sufficient time period for bonding to occur. It is preferably done in a reducing atmosphere to avoid formation of oxides. See Marks' Standard Handbook for Mechanical Engineers, Avallone, Eugene and Baumeister III, Theodore, editors, pages 13–22, 13–23, (McGraw-Hill, $9^{th}$ ed. 1987). In brazing, coalescence is produced by heating above 450° C. but below the melting point of the metals being joined. A filler metal having a melting point below that of the metals being joined is distributed in the interface between the plate and the wick by capillary attraction. Id. at page 13–41. Of course, the invention can be practiced using other bonding schemes, including diffusion bonding or chemical bonding.

The metal wick is selected for its tensile strength based upon the desired working fluid, preferably 2.5 times the vapor pressure of the working fluid at the designed maximum operating temperature. System geometry also plays a part. The wider the vapor grooves are with respect to the spacing between the vapor grooves, the higher the tensile strength of the wick material needs to be. That is because wider vapor grooves means there is less surface area of the plates (between the vapor grooves) to be bonded to the wick. Of course, when the working fluid chosen is a low pressure fluid, then there is no requirement for significant tensile strength in the wick for structure support. Thus, non-metallic wick material is appropriate for use with low pressure fluids in the flat capillary evaporator.

A liquid manifold 112 is affixed at one end of the wick 108, and a vapor manifold 114 is disposed at the opposite end of the wick 108. The direction of fluid flow through the wick 108 and vapor grooves 106 is from the liquid manifold 112 to the vapor manifold 114.

According to the preferred embodiment illustrated in FIG. 7, liquid manifold 112 encloses a liquid return line 116 (e.g., a bayonet liquid return line) and a secondary wick 118 formed of wick mesh, or other wicking material. The secondary wick 118 is not required for loop orientations where the liquid from the hydro-accumulator is gravity fed to the evaporator. The secondary wick is designed so that vapor vent channels 128 are formed between the wick 108 and the hydroaccumulator (i.e., liquid manifold 112). For purposes of clear illustration, this schematic view is simplified in that it does not portray certain preferred liquid return mechanism information (refer to FIG. 10, for example, for more details on these aspects of the preferred embodiment).

Figure 8:
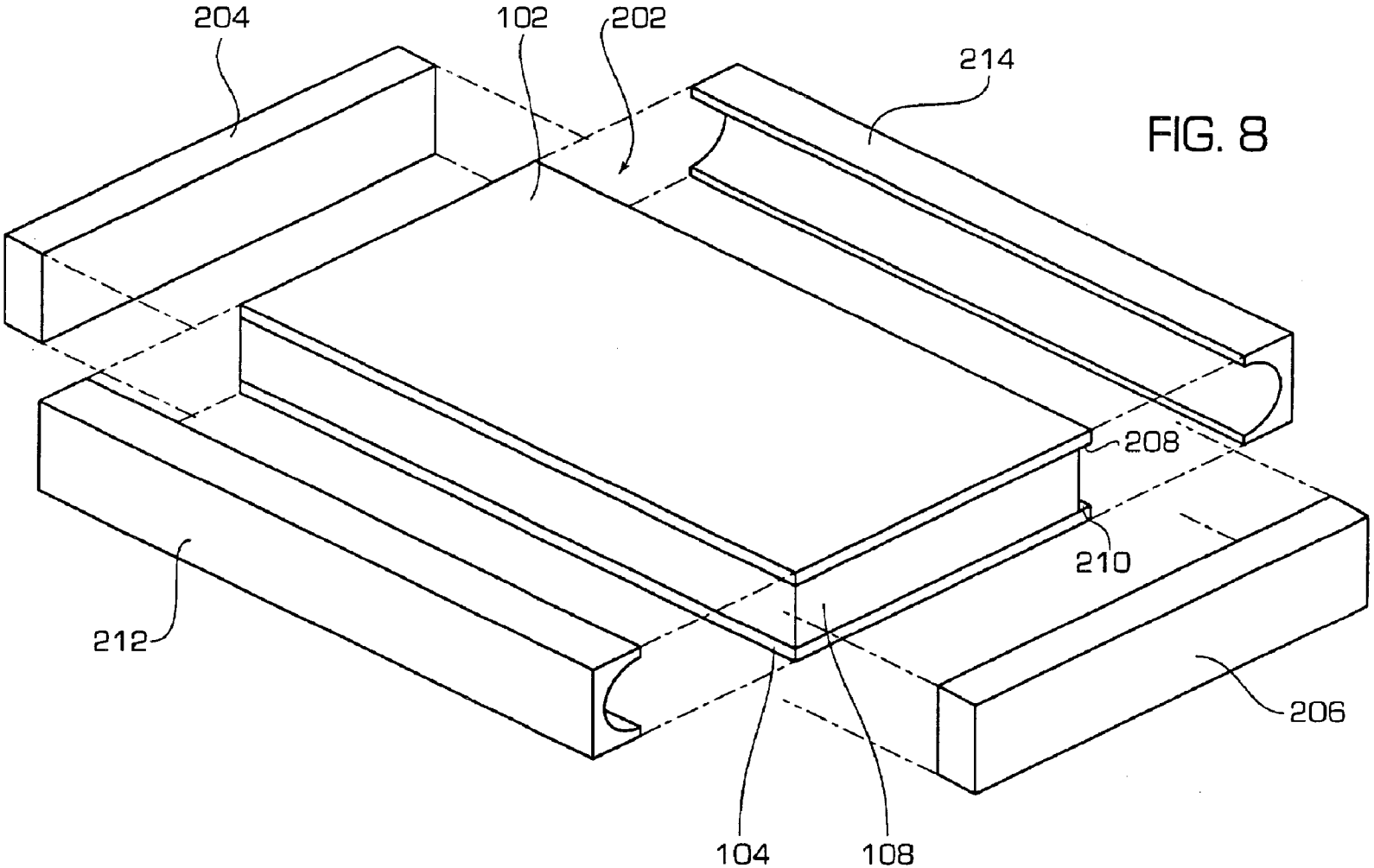
FIG. 8 illustrates an exploded view of a flat capillary evaporator according to an embodiment of the present invention.

Referring to the exploded diagram of FIG. 8, a plate/wick assembly 202 is formed by the combination of the wick 108 sandwiched between, and bonded to, the plates 102, 104. The plate/wick assembly 202 is flush on the three sides adjacent the liquid manifold 212 and the side bars 204, 206. The plates 102, 104 both extend beyond the wick 108 to form overhangs 208, 210 on the side adjacent the vapor manifold 214. The length of the overhangs 208, 210 are preferably in the range of about 0.03 to about 0.04 inches.

The vapor manifold 214 has a semicircular cutout where the diameter is approximately equal to the thickness of the wick 108. The liquid manifold 212 also has a semicircular cutout where the diameter is approximately equal to the thickness of the wick 108. A pair of side bars 204, 206 are affixed to opposing sides of the plate/wick assembly 202 and opposing ends of the manifolds 214, 216. As a result, the wick is completely enclosed by the upper and lower plates 102, 104, side bars 204, 206, and the manifolds 214, 216.

Operation of the flat capillary evaporator according to this embodiment will now be explained.

The housing of the flat capillary evaporator (refer to FIG. 7) has a pair of opposed, substantially flat exterior surfaces 120, 124 defined by the surfaces of the plates 102, 104 which are opposing the respective interior surfaces 122, 126 that are bonded to the wick 108. Heat is applied to the exterior surfaces 120, 124, which evaporates the working fluid within the housing, primarily near the vapor grooves 106. The vaporized working fluid escapes through the vapor grooves 106 and then exits the evaporator 100 through the vapor manifold 114.

The plate/wick assembly 202 may be embodied variously by being formed of a combination of materials that are selected based on a number of considerations, including:

Suitability for bonding (e.g., sintering or brazing);

The anticipated pressure range (high or low); and

Avoidance of corrosion.

Both the pressure range and corrosion are primarily affected by the choice of working fluid. Examples of metals suitable for use with high-pressure working fluids are: stainless steels, nickel (including alloys thereof), and titanium (including alloys thereof).

Applicable wick properties for evaporator functionality are in the ranges listed in Table 1 below.

TABLE 1

| WICK CHARACTERISTIC | APPLICABLE RANGE |
|---|---|
| Bubble point | 0.01 to 100 micron |
| Permeability | $10^{-10}$ to $10^{-16}$ $m^2$ |
| Porosity | 30% to 90% void volume |
| Tensile Strength | Dependent on choice of working fluid and system geometry |

The width, thickness, and length dimensions of the evaporator are not critical and may be chosen so as to be suitable for any required cooling situation. Likewise, the power input and the geometries of the liquid manifold, the vapor grooves, and the wick vary according to the specific applications and will be readily apparent to those skilled in the art.

According to an alternate embodiment, the flat capillary evaporator may be adapted particularly for heat input being transferred via only a single plate. A reduction in manufacturing cost is effected by forming vapor grooves (e.g., via etching or machining) in only one plate.

It is preferred that the vapor grooves of the present invention be formed as high-density microchannels. The use of high-density microchannel vapor grooves is advantageous because it results in a high film coefficient. It is preferred to form the microchannels via an etch process, since etching is an economically efficient process for forming highly dense microchannels.

The evaporator housing may be manufactured in a variety of ways. Plate stock may be bent in a half-cylinder shape to form suitable manifolds, like the liquid and vapor manifolds 112, 114 shown in FIG. 7. Alternatively, the manifolds may be machined from stock, like the liquid and vapor manifolds 212, 214 shown in FIG. 8. As a further alternative, each manifold may be machined together with one of the plates as a unitary part. Of course, each of the parts may be formed individually (as shown in FIG. 8) and then be welded or brazed together. Machined manifolds 212, 214 may be further machined, after assembly with other parts, so as to form mounting flanges, or simply to remove excess material to reduce weight.

In the flat plate evaporator embodiment (see FIGS. 7 and 8), the wick is liquid superheat tolerant based on a selection of a pore size small enough to prevent nucleation of superheated liquid flowing through the wick from the liquid return 116 to the vapor channel 106. The pore sizes may be uniform (i.e., homogeneous) across the wick material, or alternately, the pore sizes may be graded across the wick (e.g., according to the localized pressure within the wick).

The Cylindrical Capillary Evaporator Embodiment

According to another embodiment of the present invention, an evaporator for use in an LHP is configured using a cylindrical geometry.

Figure 9:
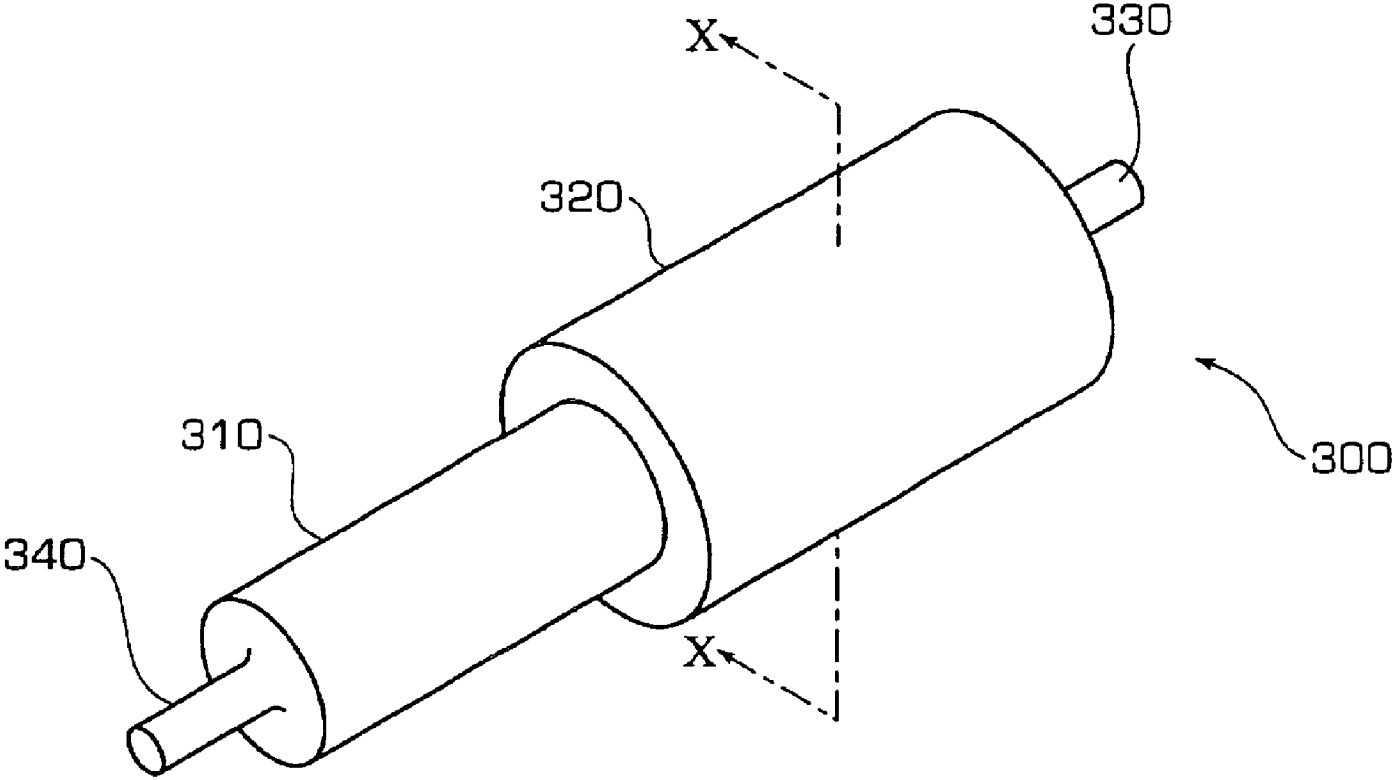
FIG. 9 illustrates a perspective view of an evaporator/reservoir assembly according to an embodiment of the present invention.

Referring to FIG. 9, a perspective view of an evaporator/reservoir assembly 300 is illustrated. The evaporator 310 is contiguous with the reservoir 320, which holds condensed working fluid that has been returned from a condenser (not shown) via the liquid return line 330. Heat energy input to the evaporator 310 vaporizes working fluid drawn from the reservoir 320 and the vaporized fluid exits through the vapor outlet 340.

Figure 10:
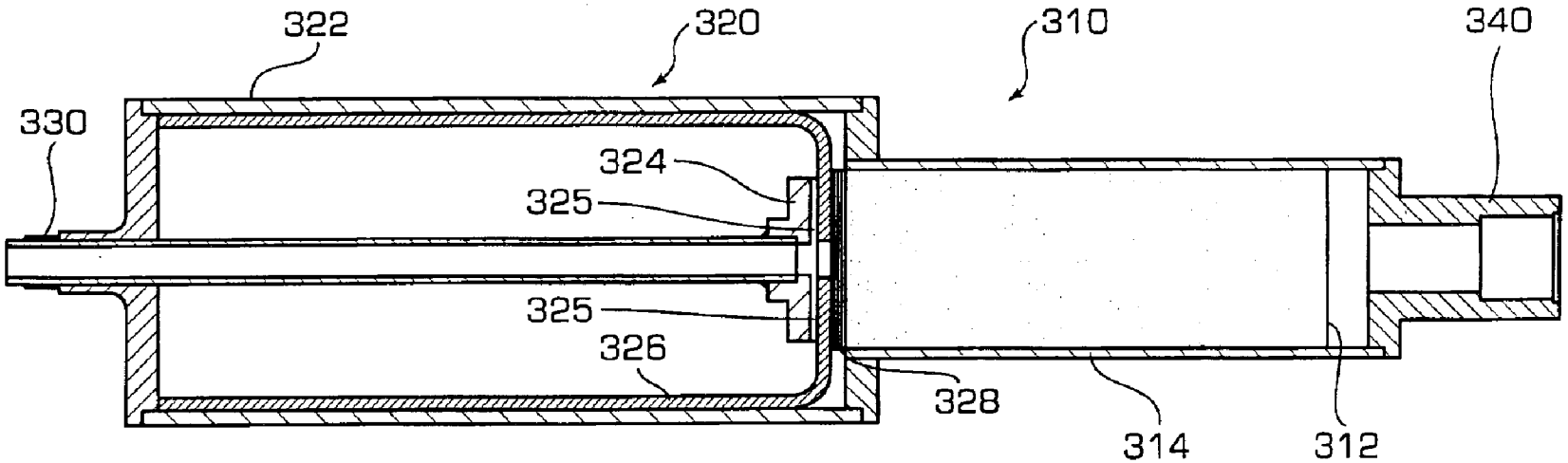
FIG. 10 illustrates a cross-section view of the evaporator/reservoir assembly of FIG. 9.

Referring to FIG. 10, a cross-section view of the evaporator/reservoir assembly 300 of FIG. 9 is illustrated. Working fluid in liquid phase returns to the reservoir 320 via the liquid return 330. Returned fluid flows into the reservoir 320 via a diffuser 324. The diffuser 324 has radial channels 325 that provide for easy passage of any vapor bubbles that may be contained in the return liquid. Inside the reservoir housing 322 is a reservoir screen 326. All flow of liquid from the reservoir 320 into the evaporator 310 is facilitated by the reservoir screen 326 and the washer 328. The reservoir screen is fixed between the diffuser 324 and the washer 328. The washer 328 is preferably embodied as four layers of 200 mesh screen cut to the diameter of the wick 312.

Working fluid flows from the reservoir into the evaporator by directly entering the wick 312, which is surrounded by an evaporator housing 314. As the working fluid emerges from the wick 312 at the vapor grooves 316, it changes phase from liquid to vapor. The vapor exits the evaporator at the vapor outlet 340.

Figure 12:
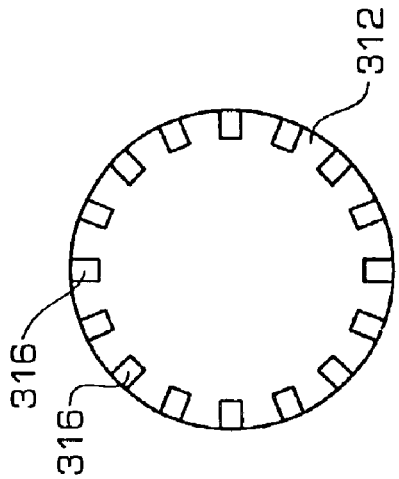
FIG. 12 illustrates an end view of the wick of FIG. 11.
Figure 11:
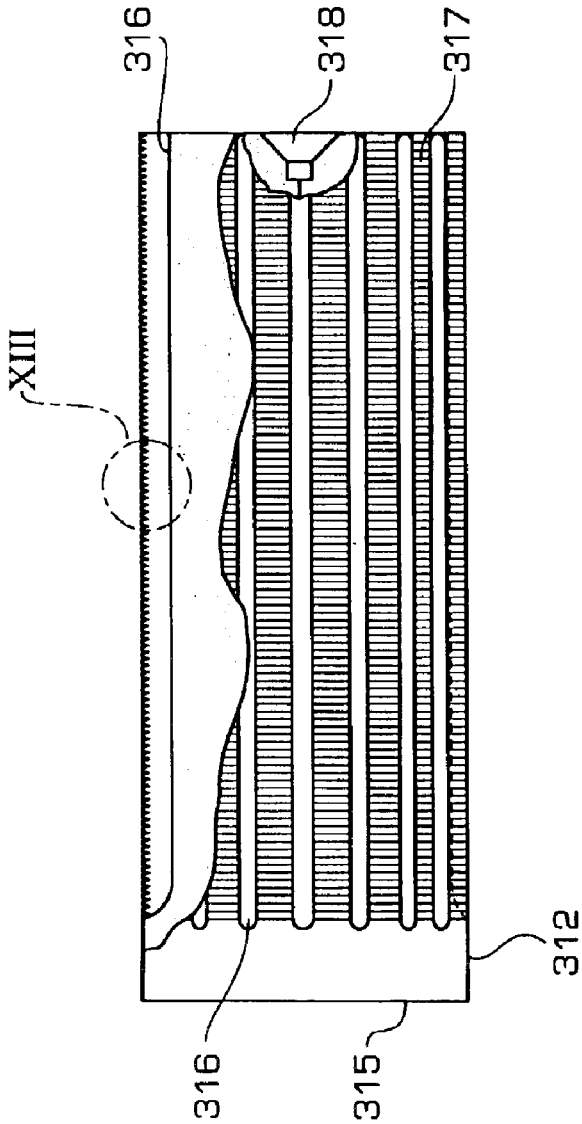
FIG. 11 illustrates a partial cross-section view of a wick structure shown in FIG. 10.

Referring to FIGS. 11 & 12, a wick structure in the evaporator of FIG. 10 is illustrated in partial cross-section view (FIG. 11) and in an end view (FIG. 12). Vapor grooves 316 are disposed around the periphery of the cylindrical wick 312. The leading end of the vapor grooves is spaced some distance from the liquid entrance end 315 of the wick 312. Small lateral grooves 317 extend between the vapor grooves 316. The small lateral grooves 317 are an optional feature, not essential to practice of the present invention.

Figure 13:
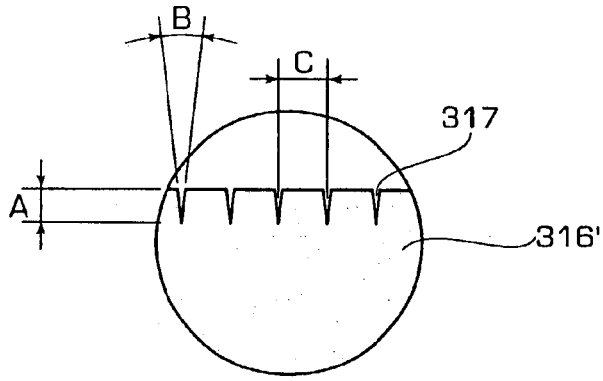
FIG. 13 illustrates a detail view of the wick of FIG. 11.

Referring to FIG. 13, a detail view of the wick of FIG. 11 is illustrated. The detail shows the side 316' of a vapor groove 316, where the small lateral grooves 317 join the vapor groove 316. As a manufacturing expedient, the small lateral grooves 317 are machined as threads about the cylindrical wick 312. The threads 317 have a depth A, taper inward at an angle B, and are spaced at a pitch C. A pitch C of about 60 threads per inch is preferred, but may vary widely. The depth A is preferably in the range of 15 to 20 thousands of an inch. The taper angle B is preferably about 16 degrees.

A wick according to the cylindrical evaporator embodiment preferably implements the liquid superheat tolerant aspects of the present invention.

The Terrestrial LHP Embodiment

According to another embodiment of the present invention, an LHP is configured to use water as the working fluid and to operate reliably under terrestrial (1 g) conditions.

Figure 14:
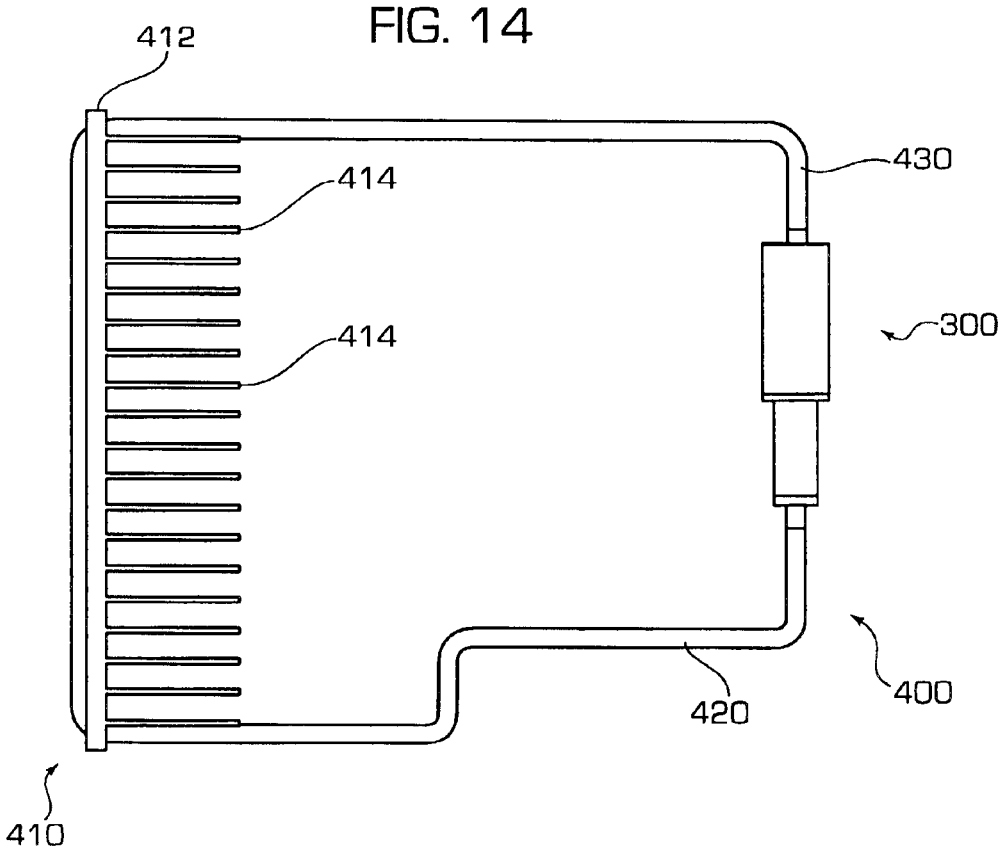
FIG. 14 illustrates a plan view of an LHP 400 according to an embodiment of the present invention.

Referring to FIG. 14, a plan view of an LHP 400 according to an embodiment of the present invention is illustrated. This LHP uses the cylindrical evaporator/reservoir assembly 300 (described in detail above) as part of its loop. The evaporator/reservoir assembly 300 is connected to a condenser 410 via a vapor line 420 and a liquid return line 430. The condenser 410 is thermally coupled to a heat sink 412 with fins 414.

As discussed above in the background section, loop heat pipes for terrestrial use have been problematic in the prior art. The primary problem has been the inability to use water or other fluids with low vapor pressure in the presence of gravity because of excessive back-conduction.

The present invention provides an LHP that operates reliably in a terrestrial environment regardless of the vapor pressure of the working fluid chosen. The evaporator employs a liquid superheat tolerant wick according to the principles disclosed above.

A working example is described below, which sets forth in detail how wick parameters may be selected to obtain optimized pumping characteristics from the evaporator alone.

A terrestrial LHP embodied according to the present invention has many advantages over other heat transfer options. For example, the standard prior art options for cooling computers and other electronics are include a heat sink (passive convection cooling) and a fan (forced convection cooling). The terrestrial LHP technology removes heat more effectively than both of these options without sacrificing reliability. It is an active system that forcibly pumps heat away from the heat source, yet it has no moving parts (other than the working fluid) to break down.

The Compact Flat LHP Embodiment

According to yet another embodiment of the present invention, an LHP is configured to be compact and integrated for use in cooling localized heat sources, such as electronics. This LHP is configured to operate reliably under terrestrial (1 g) conditions.

Figure 15:
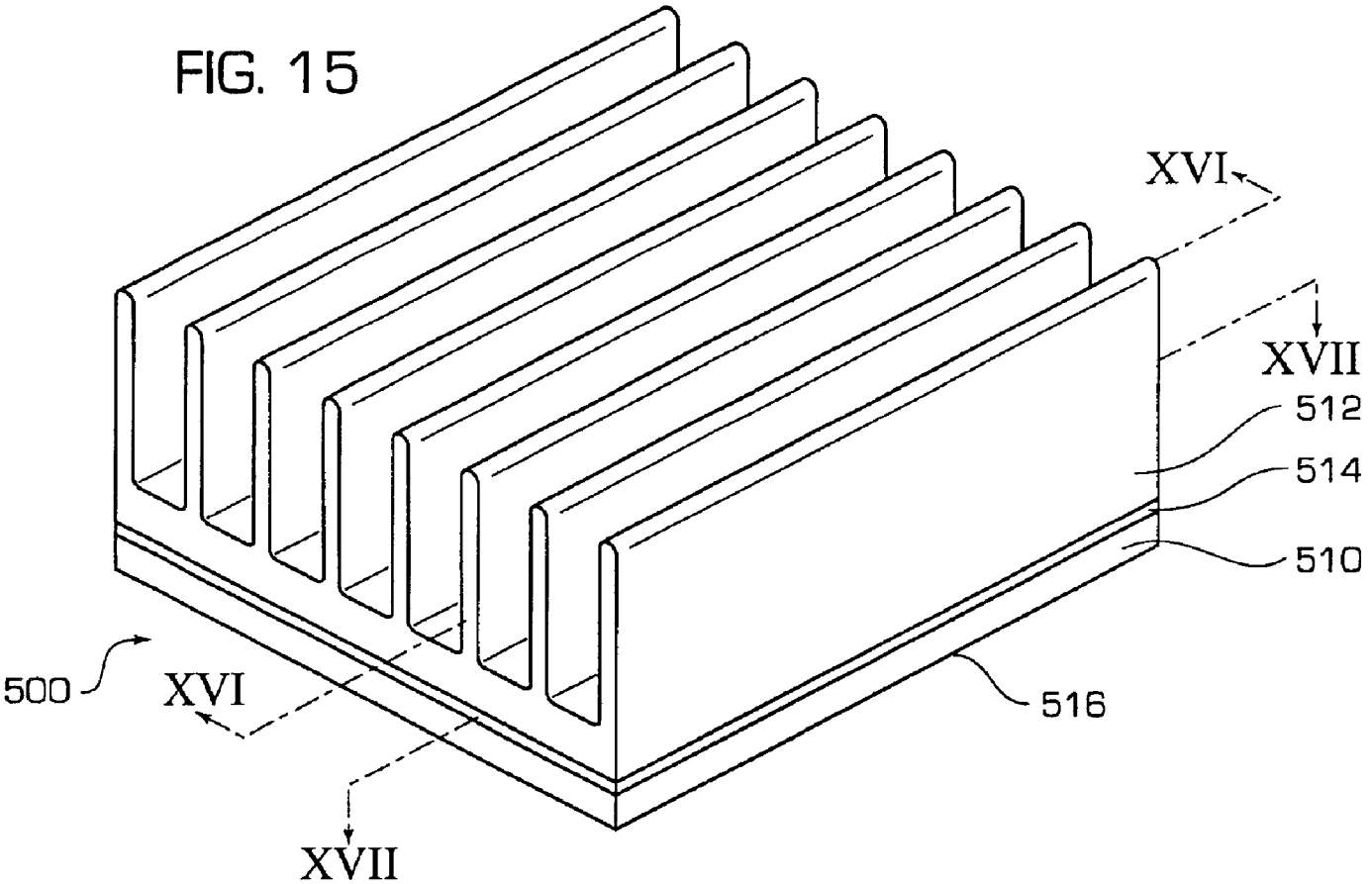
FIG. 15 illustrates a perspective view of a cooling assembly, which incorporates an LHP according to an embodiment of the present invention.

Referring to FIG. 15, a perspective view of a cooling assembly 500 incorporating an LHP according to an embodiment of the present invention is illustrated. The LHP itself is not visible in this view, which shows a component mounting face sheet 510 that is connected to a heat sink 512 via a heat sink face sheet 514. Heat generating components 522, 524 (refer to FIG. 16) to be cooled are mounted on the mounting face 516 of the component mounting face sheet 510.

Figure 16:
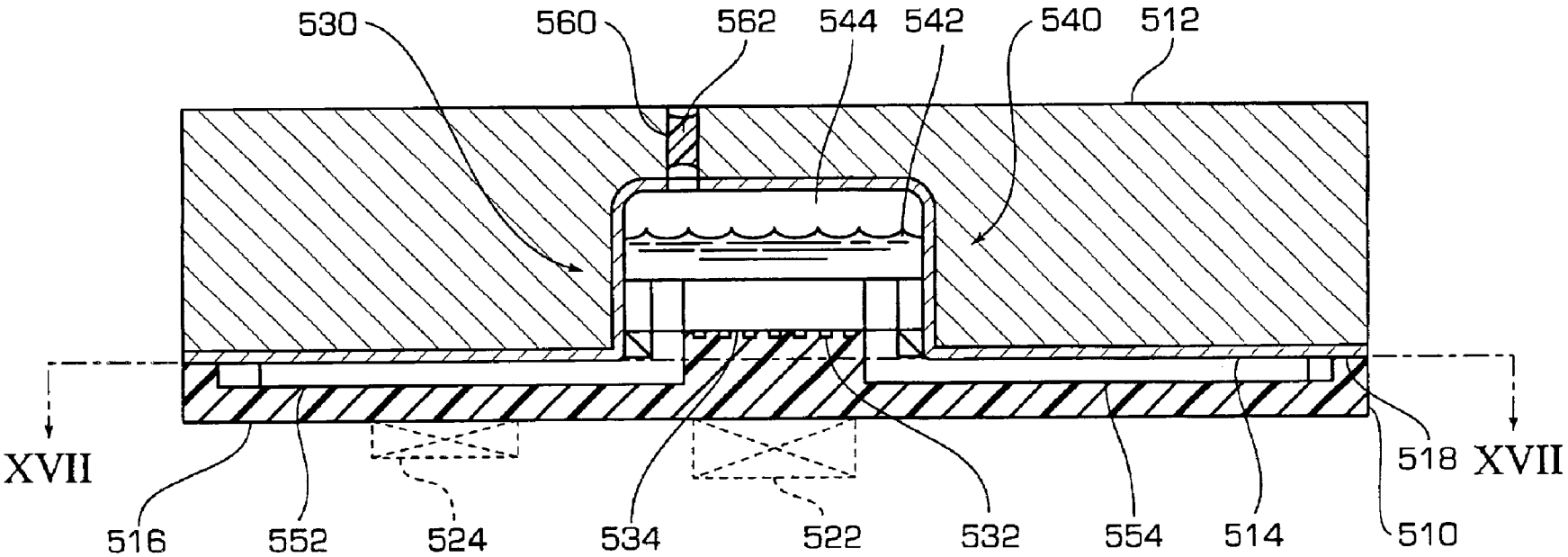
FIG. 16 illustrates a cross-section view of the cooling assembly of FIG. 15.

Referring to FIG. 16, a cross-section view of the cooling assembly 500 of FIG. 15 is illustrated. This view shows the evaporator, reservoir, and liquid return portions of the LHP structure. Heat energy is generated by components 522, 524 (shown in phantom) that are mounted on the mounting face 516 of the component mounting face sheet 510. A high power density component 522 is positioned in proximity to an evaporator portion 530 where vapor grooves 532 are disposed along the bottom side of a capillary wick 534. Lower power density components, such as component 524 are positioned on the mounting face 516 at a distance away from the evaporator portion 530. A fluid reservoir 540 is disposed above the wick 534 of the evaporator 530. The fluid reservoir 540 contains liquid 542 and, optionally, a void volume 544.

Liquid flows into the reservoir 540 via liquid return lines 552, 554 that extend from opposed ends of the component mounting surface sheet 510, and up through the wick 534 into the reservoir 540. Although the liquid return lines 552, 554 would ordinarily contain liquid, portrayal of liquid in the return lines has been omitted from this view for purposes of clarity.

The wick 534 is embodied to include the liquid superheat tolerance aspects described above, with the compromise of two fluid paths through the wick to permit flow of liquid from the return lines 552, 554 into the reservoir 540. To the extent practicable, these fluid paths through the wick 534 are kept to a minimum size and are spaced apart from the vapor grooves 532. Almost all flow of liquid through the wick 534 originates at the top surface of the wick (i.e., at the interface between the reservoir 540 and the wick 534), not from the liquid return channels.

The LHP is charged with an appropriate volume of working fluid via a charging port 560, which is then sealed with a semi-permanent plug 562.

The interface 518 between the component mounting face sheet 510 and the heat sink face sheet 514 is bonded so as to provide a hermitic seal. The bonding may be provided via sintering, brazing, welding (resistance, EB, etc.), epoxy bonding, diffusion bonding, or any other process that would provide the desired hermitic seal.

Figure 17:
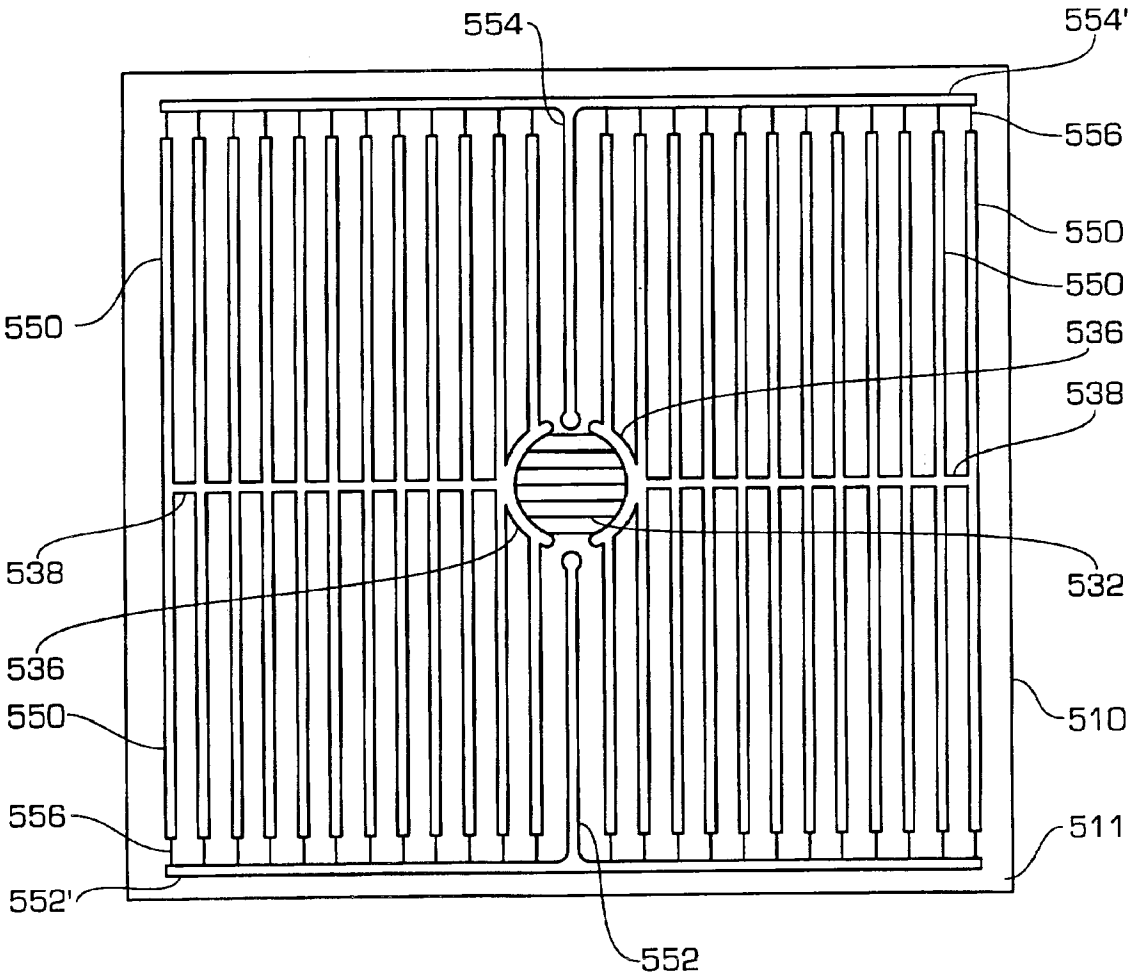
FIG. 17 illustrates another cross-section view of the cooling assembly of FIG. 15.

Referring to FIG. 17, another cross-section view of the cooling assembly 500 of FIG. 15 is illustrated. This view shows the plumbing of the vapor flow channels, condenser flow channels, and the liquid return lines, which are all machined into the upper surface 511 of the component mounting face sheet 510. Vapor grooves 532 feed vaporized working fluid from the wick 534 into a pair of opposed, arcuate vapor manifolds 536. Vapor flows from the vapor manifolds 536 into a pair of vapor flow channels 538 extending in opposite directions. Parallel condenser flow channels 550 disposed in all four quadrants of the component mounting face sheet 510 draw vaporized working fluid from the vapor flow channels 538 and the arcuate vapor manifolds 536. As it condenses, the working fluid flows from the center of the component mounting face sheet 510 out toward the periphery via the condenser flow channels 550.

At the peripheral ends of the condenser flow channels 550, the condensed working fluid is gathered in liquid return manifolds 552', 554' and returned to the liquid reservoir via liquid return channels 552, 554. To provide for uniform fluid flow through each of the condenser flow channels 550, a micromachined capillary flow regulators 556 are disposed between the peripheral end of each of the condenser flow channels 550 and the liquid return manifolds 552', 554'.

Heat released via condensation flows upwardly into the heat sink 512. This has the overall affect of not only cooling the mounting face 516, but isothermalizing the mounting face. That is, the temperature of the mounting face 516 is more-or-less equalized, rather than being particularly hot in the center where the high power density component 522 is disposed.

Working Example

A working example according to a flat capillary evaporator embodiment of the present invention is described as follows.

Ammonia is chosen as the working fluid. This is a high-pressure working fluid. The vapor pressure of ammonia at 60° C. is 2600 kPa. Accordingly, the tensile strength of the wick and the bond should be at least about 6500 kPa. The wick is stainless steel because of its high strength properties and its resistance to corrosion in an ammonia environment.

The active length of the heat input surface of the evaporator is 2 inches. A high heat flux of 40 W/in.$^2$ over 0.25 in. is located near the liquid manifold, with a load of 1 W/in.$^2$ over the remainder of the heat input surface.

Figure 18:
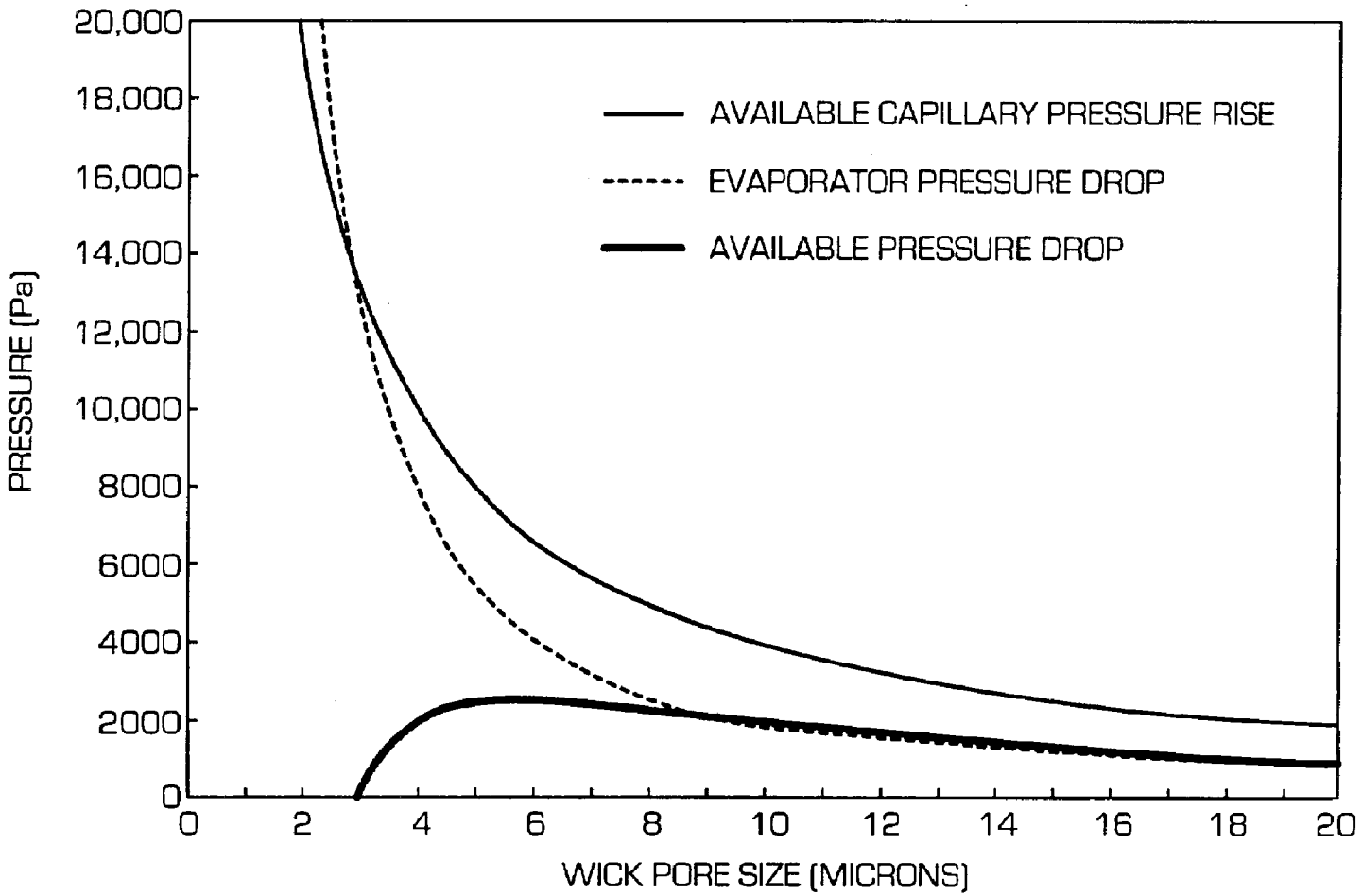
FIG. 18 illustrates graphical performance curves for a working example of a flat plate evaporator according to an embodiment of the present invention.

Referring to FIG. 18, performance curves for the exemplary flat plate evaporator are illustrated on a graph. The thin solid line curve represents available capillary pressure rise ($\Delta P_{CAPILLARY}$), the broken line curve represents evaporator pressure drop ($\Delta P_{DROP}$), and the thick solid line curve represents available pressure drop ($\Delta P_{AVAILABLE}$). For the wick material and working fluid chosen in this working example, the optimum wick pore size to achieve the maximum $\Delta P_{AVAILABLE}$ of 2900 Pa is a 6 micron wick. FIG. 18 also demonstrates the phenomenon that below a certain pore size (in this case, 3 microns) the evaporator pressure drop exceeds the available capillary pressure head.

Having thus described the basic concepts of the invention, it will be readily apparent to those skilled in the art that the foregoing detailed disclosure is intended to be presented by way of example only, and is not limiting. Various alterations, improvements and modifications will occur to those skilled in the art, but are not expressly stated above. These and other modifications, alterations and improvements are intended to be suggested by the disclosure herein, and are within the scope of the invention. Accordingly, the present invention is limited only by the following claims and equivalents thereto.

What is claimed is:

1. A cooling device comprising:

a heat sink having a heat receiving face; and a heat transfer system adjacent the face of the heat sink, the heat transfer system comprising:

a component mounting face sheet;

an evaporator disposed on the component mounting face sheet and comprising:

a capillary wick, and vapor grooves formed between the component mounting face sheet and the capillary wick;

a fluid reservoir disposed between the evaporator and the heat sink;

a condenser comprising plural condenser flow channels disposed in the component mounting face sheet;

one or more vapor flow channels providing fluid connection between the vapor grooves and the condenser flow channels; and one or more liquid return channels providing fluid connection between the condenser flow channels and the fluid reservoir;

wherein heat generating components to be cooled are configured to be mounted on the component mounting face sheet.

2. The cooling device of claim 1 wherein the heat transfer system is embedded in the face of the heat sink, and the capillary wick is contained within the evaporator and segregated from the condenser.

3. The cooling device of claim 2, wherein the heat transfer system operates reliably in a terrestrial gravitational field.

4. The cooling device of claim 2, further comprising a working fluid within the heat transfer system.

5. The cooling device of claim 1, wherein the liquid return channels are positioned between the heat sink and the component mounting face sheet.

6. The cooling device of claim 1, wherein the vapor grooves are formed in the component mounting face sheet.

7. The cooling device of claim 1, wherein the vapor grooves are formed in the capillary wick.

8. The cooling device of claim 1, wherein the heat transfer system includes a reservoir positioned adjacent the capillary wick.

9. The cooling device of claim 8, wherein the reservoir is in fluid communication with the capillary wick.

10. The cooling device of claim 1, further comprising a working fluid within the heat transfer system.

11. The cooling device of claim 1, wherein the evaporator is positioned between the component mounting face sheet and the heat sink.

12. A cooling device comprising:

a heat sink having a heat receiving face; and a heat transfer system adjacent the face of the heat sink, the heat transfer system comprising:

a component mounting face sheet;

an evaporator disposed on the component mounting face sheet and comprising:

a capillary wick, and vapor grooves formed between the component mounting face sheet and the capillary wick; and a condenser coupled to the evaporator; wherein the condenser is positioned within the component mounting face sheet.

13. The cooling device of claim 12, wherein the heat transfer system includes a vapor flow channel providing fluid connection between the vapor grooves within the evaporator and condenser flow channels within the condenser.

14. The cooling device of claim 12, wherein the heat transfer system includes a liquid return channel providing fluid connection between condenser flow channels within the condenser and a reservoir coupled to the evaporator.

15. The cooling device of claim 13, wherein the capillary wick is configured to prevent nucleation of a working fluid inside the wick body.

16. The cooling device of claim 12, wherein the heat transfer system is embedded in the face of the heat sink, and the capillary wick is contained within the evaporator and segregated from the condenser.

17. The cooling device of claim 12, wherein the capillary wick is configured to prevent nucleation of a working fluid inside the wick body.

18. The cooling device of claim 12, wherein the heat transfer system operates reliably in a terrestrial gravitational field.

19. The cooling device of claim 12, further comprising a working fluid within the heat transfer system.

20. The cooling device of claim 12, wherein the vapor grooves are formed in the component mounting face sheet.

21. The cooling device of claim 12, wherein the vapor grooves are formed in the capillary wick.

22. The cooling device of claim 12, wherein the heat transfer system includes a reservoir positioned adjacent the capillary wick.

23. The cooling device of claim 22, wherein the reservoir is in fluid communication with the capillary wick.

24. The cooling device of claim 12, wherein the evaporator is positioned between the component mounting face sheet and the heat sink.

25. A cooling device comprising:

a heat sink having a heat receiving face; and a heat transfer system embedded in the face of the heat sink, the heat transfer system comprising:

a component mounting face sheet;

a condenser including a condenser flow channel;

a fluid reservoir disposed between the evaporator and the heat sink;

an evaporator disposed on the component mounting face sheet and comprising:

a capillary wick contained within the evaporator and segregated from the condenser; and vapor grooves formed between the component mounting face sheet and the capillary wick;

a vapor flow channel providing fluid connection between the vapor grooves and the condenser flow channel; and a liquid return channel providing fluid connection between the condenser flow channel and the fluid reservoir;

wherein the condenser flow channel is connected to one of the liquid return channel via a capillary flow regulator.

26. The cooling device of claim 25, wherein the capillary flow regulator is micromachined into the component mounting face sheet.

27. A cooling device comprising:

a heat sink having a heat receiving face; and a heat transfer system embedded in the face of the heat sink, the heat transfer system comprising:

a component mounting face sheet;

a condenser including a condenser flow channel;

a fluid reservoir disposed between the evaporator and the heat sink;

an evaporator disposed on the component mounting face sheet and comprising:

a capillary wick contained within the evaporator and segregated from the condenser; and vapor grooves formed between the component mounting face sheet and the capillary wick;

a vapor flow channel fluidly coupled to the vapor grooves and the condenser flow channel; and a liquid return channel fluidly coupled to the fluid reservoir and the condenser flow channel;

wherein the vapor flow channel, the liquid return channel, and the condenser flow channel are substantially co-planar with one another.

* * * * *

UNITED STATES PATENT AND TRADEMARK OFFICE

CERTIFICATE OF CORRECTION

PATENT NO. : 6,915,843 B2
APPLICATION NO. : 10/388955
DATED : July 12, 2005
INVENTOR(S) : Edward J. Kroliczek, Kimberly R. Wren and David A. Wolf, Sr.

It is certified that error appears in the above-identified patent and that said Letters Patent is hereby corrected as shown below:

On the title page:

In ITEM (57) ABSTRACT change “that” to --than--

In the specification:

| | | |
|---|---|---|
| COLUMN 2, | LINE 14, | change “balance” to --balanced-- |
| COLUMN 2, | LINE 26, | after “approach” and before “sink” insert --heat-- |
| COLUMN 2, | LINE 62, | change “evaporator of” to --evaporator 10 of-- |
| COLUMN 2, | LINE 64, | change “evaporator of” to --evaporator 50 of-- |
| COLUMN 3, | LINE 53, | change “Capillary Pumped” to --Capillary-Pumped-- |
| COLUMN 4, | LINE 44, | change “as a practical choices” to --as practical choices-- |
| COLUMN 6, | LINE 65, | change “FIG. 6,” to --FIG. 6-- |
| COLUMN 7, | LINE 48, | change “reduce” to --reduces-- |
| COLUMN 8, | LINE 11, | change “central flow path 2” to --central flow channel 2-- |
| COLUMN 8, | LINE 37, | change “increasing” to --increase-- |
| COLUMN 8, | LINE 53, | change “non-metalic” to --non-metallic-- |
| COLUMN 11, | LINE 23, | change “manifolds 214, 216.” to --manifolds 212, 214.-- |
| COLUMN 11, | LINE 25, | change “manifolds 214, 216.” to --manifolds 212, 214.-- |
| COLUMN 13, | LINE 51, | delete “are” |
| COLUMN 14, | LINE 18, | change “evaporator 530.” to --evaporator portion 530.-- |

UNITED STATES PATENT AND TRADEMARK OFFICE

CERTIFICATE OF CORRECTION

PATENT NO. : 6,915,843 B2
APPLICATION NO. : 10/388955
DATED : July 12, 2005
INVENTOR(S) : Edward J. Kroliczek, Kimberly R. Wren and David A. Wolf, Sr.

It is certified that error appears in the above-identified patent and that said Letters Patent is hereby corrected as shown below:

| | | |
|---|---|---|
| COLUMN 14, | LINE 43, | change “hermitic” to --hermetic-- |
| COLUMN 14, | LINE 46, | change “hermitic” to --hermetic-- |
| COLUMN 15, | LINE 1, | delete “a” |

Signed and Sealed this

Third Day of March, 2009

John Doll

JOHN DOLL
*Acting Director of the United States Patent and Trademark Office*